US005566734A

United States Patent [19]

Levy et al.

[11] Patent Number: 5,566,734

[45] Date of Patent: Oct. 22, 1996

[54] PLEATED WINDOW SHADE

[76] Inventors: Arnold Levy; Frank L. Meyer, both of 7327 Lankershim Blvd., Unit 6, North Hollywood, Calif. 91605

[21] Appl. No.: 393,368

[22] Filed: Feb. 23, 1995

[51] Int. Cl.[6] ..... E06B 9/06

[52] U.S. Cl. ..... 160/84.04; 160/121.1

[58] Field of Search ..... 160/84.01, 84.04, 160/84.05, 121.1, 124, DIG. 7, 348, 236, 238, 405

[56] References Cited

U.S. PATENT DOCUMENTS

| | | | |
|---|---|---|---|
| 2,636,556 | 4/1953 | Light et al. | 160/167 V |
| 2,874,612 | 2/1959 | Luboshez | 88/60 |
| 3,011,174 | 12/1961 | Schaerer | 160/348 |
| 3,443,860 | 5/1969 | Luboshez | 350/263 |
| 3,487,875 | 1/1970 | Shukat et al. | 160/84.01 |
| 4,019,554 | 4/1977 | Rasmussen | 160/84 |
| 4,069,857 | 1/1978 | Brookshire | 160/84.04 |
| 4,519,435 | 5/1985 | Stier | 160/236 X |
| 4,535,828 | 8/1985 | Brockhaus | 160/84 R |
| 4,677,013 | 6/1987 | Anderson | 160/84.01 X |
| 4,931,342 | 6/1990 | Tolbert et al. | 428/90 |
| 5,117,895 | 6/1992 | Simon | 160/263 |
| 5,313,999 | 5/1994 | Colson et al. | 160/121.1 |
| 5,355,928 | 10/1994 | Robertson | 160/84.04 |

*Primary Examiner*—David M. Purol
*Attorney, Agent, or Firm*—Robert Louis Finkel

[57] ABSTRACT

A pleated construction for roll-up and pull-up window shades, and a pleated material for use as the window covering in such shades. The material comprises a facing layer of horizontally closely-pleated fabric that is tightly, adhesively bonded or fused to a backing layer of durable, pliable fabric so as to retain the pleats permanently. Preferably, the backing layer is coated or impregnated with a thermoplastic material that fuses the pleated fabric to it with the application of heat and pressure. The window covering is tacked, stapled, or adhered to a conventional spring-actuated roller or pull-up mounting apparatus and serves in the same manner as a covering made of conventional shade material. If desired, a liner may be applied to the rear side of the window covering to enhance its appearance and maintain the shape of the shade. Window coverings incorporating the subject material can be made up in any desired width and length for which facing and backing fabrics are available.

9 Claims, 2 Drawing Sheets

PLEATED WINDOW SHADE

BACKGROUND

1. Field of the Invention

This invention relates to window shades, and especially to roll-up and pull-up shades incorporating decorative window-covering materials. More particularly it relates to such shades in which the window-covering materials are pleated, or treated so as to give a pleated appearance.

2. Prior Art

Conventional window shades are generally thought of as inexpensive, utilitarian alternatives to curtains, drapes, shutters, blinds and other window coverings. The principal criteria for their design are that they keep out unwanted light, afford some privacy, and allow the user access to the window. Normally, little attention is paid to their aesthetic appearance.

Two types of shades are in common use. In one, the window-covering material is wound around a spring-actuated or hangcord-rotated roller. In the other, the covering material is pulled up in "Roman"-folds. In each instance, in addition to satisfying the first two criteria, that is, providing shade and privacy, the window covering material must be capable of being rolled or folded compactly and neatly. The vast majority of roll-up and pull-up shades produced today are made of plain, unadorned, natural or synthetic fabric, oilcloth, parchment paper, or the like.

Recent trends in interior design have created an interest in giving the heretofore drab window shade a new look. The response has been an outpouring of "designer" shades incorporating new materials and treatments. Typically, however, these materials are merely sheets or laminates of conventional window- or wall-covering fabrics with well known surface textures, designs, and appliques not previously employed in window shades.

Among the new treatments, several feature pleats or folds formed by gathering the fabric itself. The pleating is generally accomplished by means of permanent stitching or ties, the folding customarily by the use of laces or pull-cords passing through the fabric. A major deficiency common to many of the new materials and treatments is that they are too thick and inflexible to be wound or folded neatly and compactly. None of these techniques is suitable for use in roll-up shades. In pull-up shades the pleats and folds are unsightly and ungainly, and the loose laces and cords easily become tangled. Additionally, with use, the stitches, ties, laces, cords and fabric all tend to wear quickly and fail early.

We have developed a construction and material for roll-up and pull-up window shades which overcome all of the aforementioned drawbacks and provide a number of advantages.

One object of our invention is to provide a construction and window covering material which allow those skilled in the art to produce pleated roll-up and pull-up shades incorporating a wide variety of conventional types of fabrics.

Another object is to provide a construction and window covering material which enable those skilled in the art to produce fully pleated roll-up and pull-up window shades with fabrics of their choice.

Still another object is to provide a construction and window covering material for roll-up and pull-up shades which are extremely durable.

A further object is to provide a construction and window covering material for roll-up and pull-up shades which do not require special or unconventional mounting hardware.

Yet another object is to provide a construction and window covering material for pleated roll-up and pull-up shades in which unsightly stitching, threads, and ties are not visible.

SUMMARY OF THE INVENTION

The subject material comprises a facing layer of pliable fabric having narrow, horizontal pleats permanently bonded to a durable, pliable backing. Preferably, the backing is a thin layer of nonwoven interfacing impregnated with a thermoplastic adhesive that fuses with the pleated fabric on the application of heat and pressure.

As will be shown and explained more fully below, a window covering of the bonded, pleated material is made, or cut, to the desired size and tacked or stapled to a conventional spring-actuated roller or pull-up mounting apparatus. In most respects a shade incorporating the subject material serves in the same manner as one made of conventional shade material. The difference in function and appearance between a shade made of conventional material, even conventional pleated or folded material, and one made of the disclosed permanently pleated material, however, is substantial.

BRIEF DESCRIPTION OF THE DRAWINGS

For a fuller understanding of the invention, reference is made to the accompanying drawings, in which.

Wherever practicable, the same numeral is used to identify identical or substantially similar features appearing in the several figures.

DETAILED DESCRIPTION OF THE PREFERRED EMBODIMENTS

Figure 1:
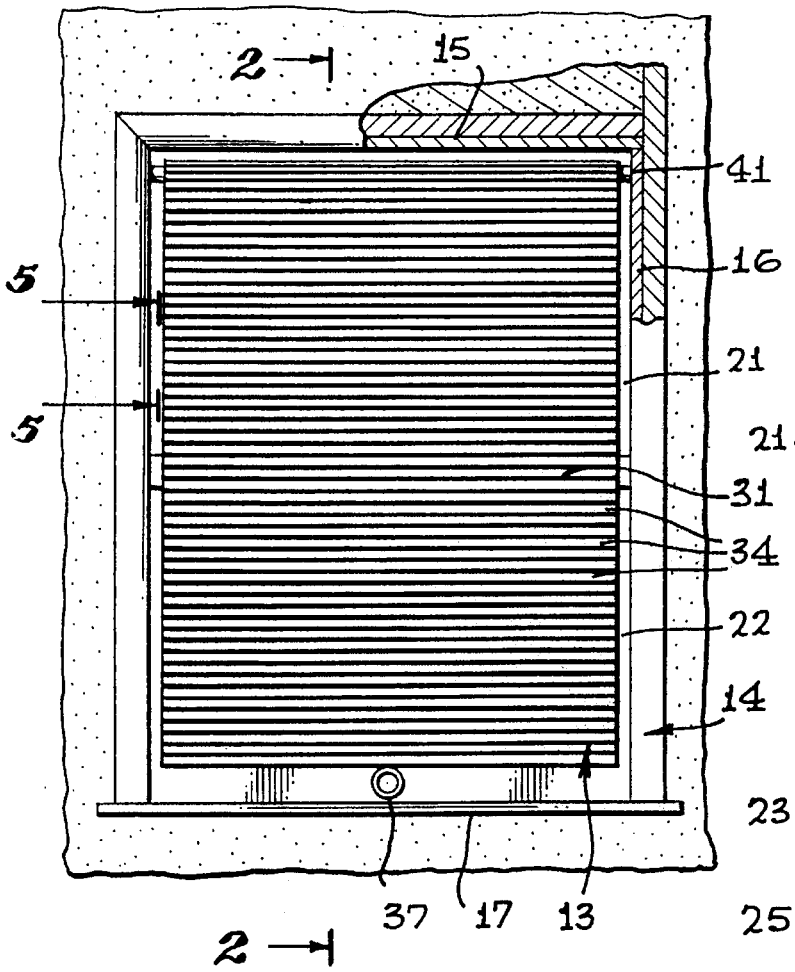
FIG. 1 is a front elevational view of a spring-actuated roll-up window shade embodying the subject invention mounted in a typical casement window, with portions cut away to show the window's construction.
Figure 2:
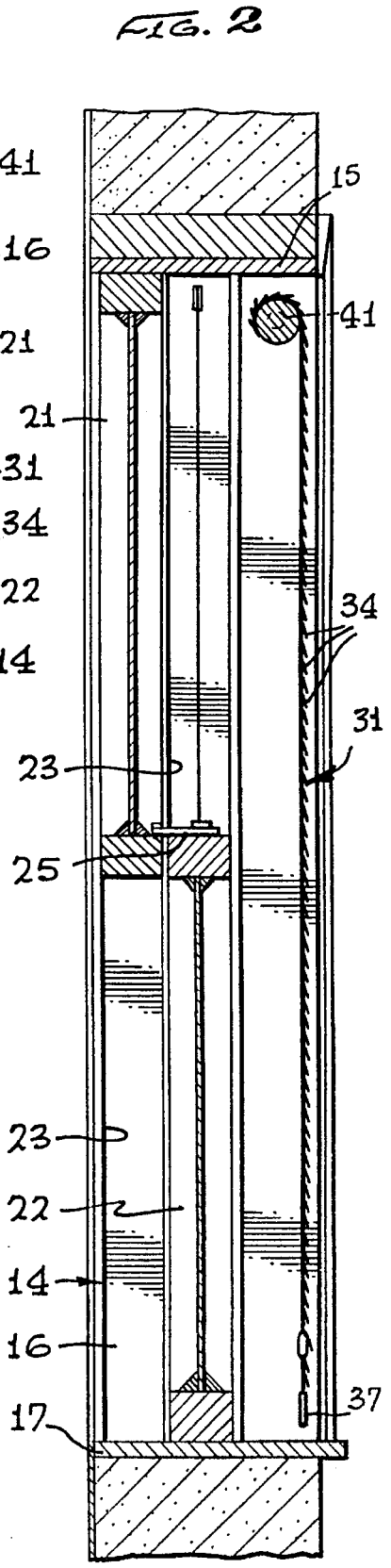
FIG. 2 is a side sectional view of the window and shade of FIG. 1, taken in the direction 2—2.
Figure 3:
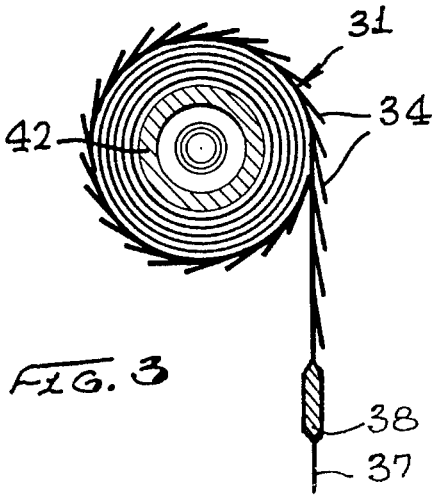
FIG. 3 is an enlarged side elevational view of the shade of FIG. 1 in its fully rolled condition.

FIGS. 1–3 illustrate a roll-up shade 13 embodying our invention mounted to a typical casement window 14. The casement comprises top frame member 15, side frame members 16, and sill 17. Conventionally, offset upper and lower window sections 21, 22 are mounted to slide past one another in channels 23 formed in the side frame members 16. Counterweights (not visible) attached to each side of sections 21, 22 by means of cords passing over pulleys mounted in openings in the side frame members 16 facilitate the positioning of the sections 21, 22 for ventilation and cleaning. Mating locking hardware 25 on sections 21 and 22 allows the window 14 to be locked closed. Some windows are provided with means (not shown) for securing the sections 21, 22 in intermediate positions as well.

Figure 5:
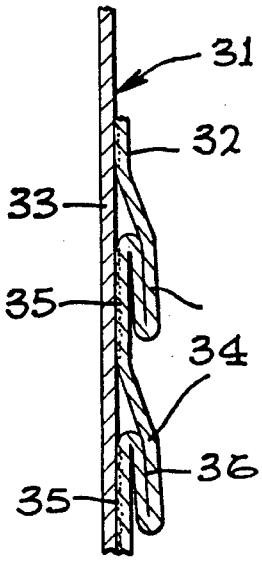
FIG. 5 is an enlarged fragmentary sectional view of the window covering material of the shade of FIG. 1, taken in the direction 5—5.
Figure 6:
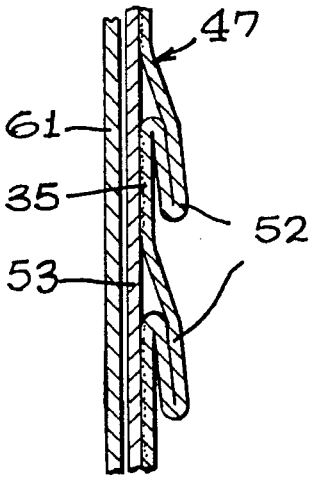
FIG. 6 is an enlarged fragmentary sectional view of the window covering portion of the shade of FIG. 4, taken in the direction 6—6.

The window covering portion 31 of shade 13 is a laminate comprising a horizontally closely-pleated facing layer 32 and a backing layer 33. As best seen in FIG. 5, facing layer 32 is formed from a pliable, lightweight to midweight fabric. Virtually any suitable natural or synthetic fabric of up to, and in some instances, greater than canvas weight can be used. The fabric can be plain or patterned. Its surface can be smooth or textured. We have found that woven or knit fabrics are easy to use and produce shades of attractive appearance, however, with appropriate processing, double-knit, nonwoven, and other types of fabric are useable.

The fabrics which will become layer 32 and backing layer 33 are cut to provide a finished width slightly narrower than the framed width of window 14. The fabric used to form layer 32 is cut substantially longer than backing layer 33. In preparation for laminating layer 32 to layer 33, the fabric of layer 32 is gathered lengthwise into a series of pleats 34 extending from side to side in what will be horizontal orientation when the shade 13 is hung in place covering window 14. We prefer the pleats 34 to be narrow (from about ⅜" to about 2", and preferably from about ¾" to about 1¼" wide), uniform. and closely-spaced, as illustrated. The texture, fullness, and overall visual effect of the shade can be controlled by the choice of fabric and the vertical spacing used to produce the desired amount of overlap.

The pleated fabric 32 is laminated to backing layer 33, a thin, pliable sheet of durable, thermoplastic adhesive-impregnated or fusible material. Its purpose is to bond firmly to the back of fabric layer 32 and thereby permanently retain the pleats 34. Any suitable fusible backing material can be used to serve this purpose. We have had notable success using PELLON® brand fusible nonwoven interfacing distributed by The Pellon Division, Freudenberg Nonwovens Limited Partnership of New York, N.Y. With this material, bonding is achieved in seconds by the application of heat and pressure.

As best seen in FIG. 5, the bonding takes place primarily in the horizontal region of contact 35 between the backing layer 33 and the adjacent rear surface of each pleat 34. Under pressure, the molten fusible material impregnates the fabric of layer 32 and on cooling permanently bonds the two layers and maintains the shape of the pleats. Care is taken, in the selection and treatment of the fusible material applied to layer 32 and in controlling the temperature, timing, and force used in the bonding process, to avoid the bonding of adjacent portions of the inner walls of the pleats at their interfaces 36. As a result, although the pleats are firmly bonded to the backing layer 33, they retain a soft and luxuriant feeling and appearance.

Once bonded, if necessary the pleated window covering 31 can be trimmed to the length and width of window 14 without concern that the covering 31 or pleats 34 will be damaged.

Suitable means, such as conventional mounting hardware 41 and spring-operated roller 42, are provided for adjustably mounting window covering 31 to window 14. The top edge of covering 31 is tacked or stapled to roller 42 and a few turns of the covering taken around the roller to ready it for installation. That is accomplished by slipping the ends of roller 42 into hardware 41. If desired, to facilitate gripping window covering 31, grasping means, such as ring 37, may be attached to its lower end. A light downward pull on ring 37 releases the roller's latching mechanism and allows the spring to rotate the roller and raise the covering 31. Commonly, a stiffener or weighted bar 38 is inserted into a loop of material formed at the lower end of covering 31 to prevent the end of the shade from curling and to minimize its swinging.

Figure 4:
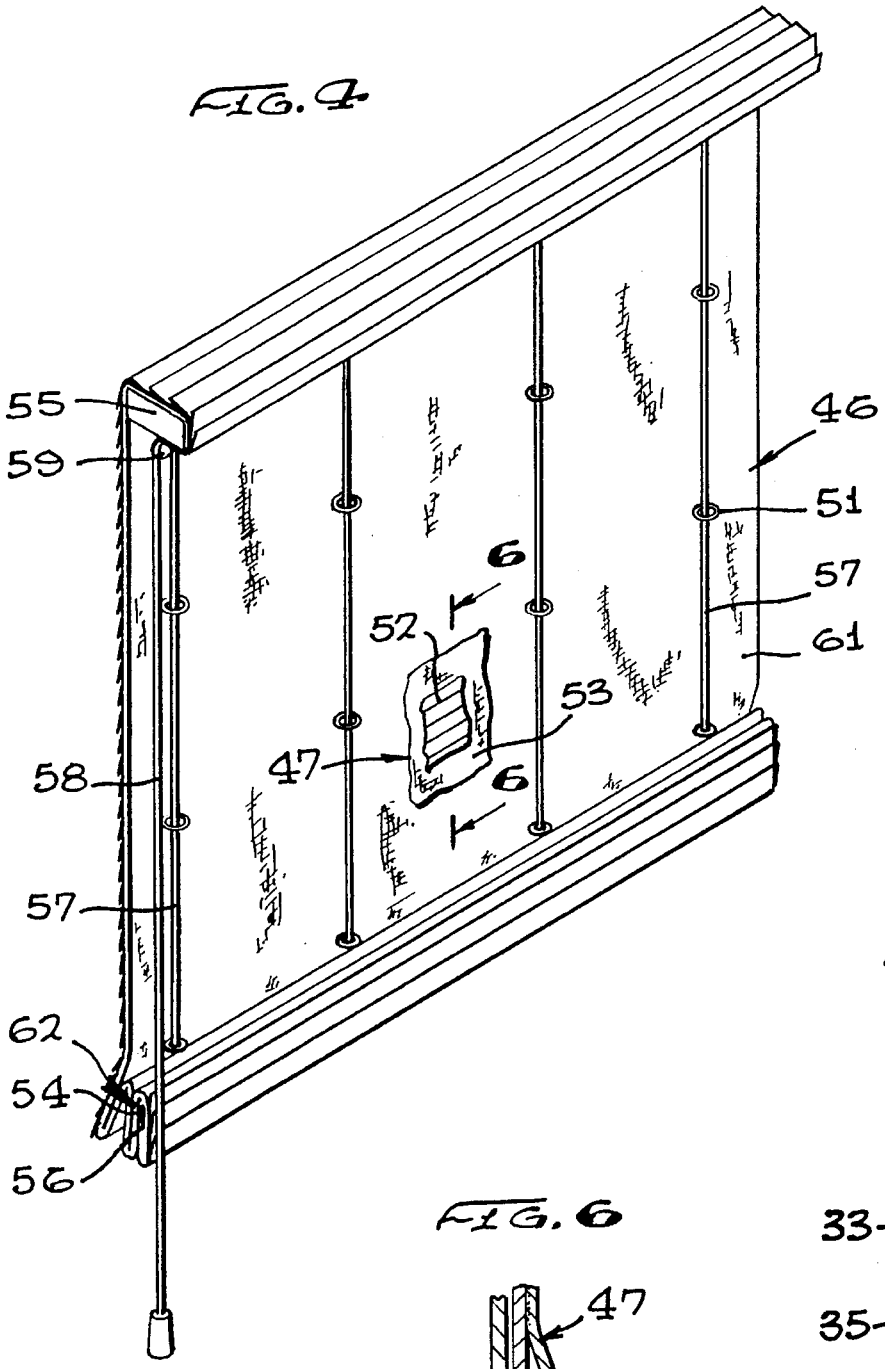
FIG. 4 is a top, rear perspective view of a Roman-fold style window shade embodying the subject invention, with a portion of the lining cut away to show the shade's construction.

FIG. 4 illustrates an alternative embodiment of our invention in the form of a Roman-style pull-up shade 46. In this configuration, the window covering 47 incorporates a pleated facing layer 52 permanently bonded to a backing layer 53 and is virtually identical to the previously described laminated window covering 31.

In this style of shade, window covering 47 is suspended from a header 55 conventionally adapted to be secured to the top window frame or to the wall adjacent the window. If desired, a fabric liner 61 can be applied, for example by stitching, to the back of window covering 47 to give the rear side of shade 46 seen through the window an aesthetically appealing look. As an additional benefit, although not critical to the construction, operation, or utility of the invention, for installations in very large windows such a liner may serve to prevent sagging and to maintain the shape of the window covering 47 in the face of shear forces. The lower end of the window covering 47 is weighted, for example by means of individual weights or an elongated metal bar contained in a suitable fold formed in the window covering 47, or liner 61, or both of them, to facilitate the even raising and lowering of the covering 47. We prefer the rigid bar 56 to individual weights, since it serves, additionally, to maintain the shape of the covering 47.

The window covering portion 47 of shade 46 is raised and lowered by a plurality of laterally spaced lift cords 57. Cords 57 are threaded through a plurality of aligned, vertically spaced eyes 51 attached to the back side of covering 47 and secured at their lower ends to the lower end of covering 47. As is typical of Roman-fold shades, the upper ends of cords 57 are connected to a shaft-winding apparatus attached to the top window frame (not shown), or gathered to pass over a pulley attached to the header (not shown), or, as illustrated in FIG. 4, connected to a common pull cord 58 passing over such a pulley 59.

In the embodiment shown, pulling downwardly on the cord 58 raises the covering 47 in a succession of horizontal, "accordion-style" folds. Since the width of each fold 54 is roughly half the vertical distance between successive horizontal rows of eyes 51, selective spacing of eyes 51 can be used to determine the size of pleated folds 54, and thus the appearance of shade 46 when it is partially or fully raised.

From the foregoing description, the advantages afforded by the novel features of our invention will be readily apparent. It should be understood, however, that while the invention has been described in terms of the constructions shown in the drawings and certain exemplary modifications thereof, it is not to be construed as limited to those embodiments. They are to be regarded as illustrative rather than restrictive. The invention encompasses any and all variations of the examples chosen for purposes of the disclosure, which do not depart from the spirit and scope of the following claims.

We claim:

1. A window shade comprising:

a pliable backing layer selectively sized and configured to conform to a window;

a facing layer of closely, horizontally pleated, pliable fabric tightly bonded to said backing layer so as to retain the pleats permanently, and with said backing layer defining a unitary, pliable window covering conforming to the window; and apparatus attached to the window covering for mounting the window covering to a window, said apparatus including adjusting means for raising and lowering the window covering with respect to such window.

2. A window shade in accordance with claim 1, wherein said backing layer includes thermoplastic bonding material.

3. A window shade in accordance with claim 2, wherein said backing layer is a fusible, nonwoven sheet.

4. A window shade in accordance with claim 1, wherein said mounting apparatus comprises a spring-driven roller.

5. A window shade in accordance with claim 1, wherein said mounting apparatus comprises pull-up hardware.

6. A window shade comprising:

a pliable, fusible, nonwoven backing sheet selectively sized and configured to conform to a window;

a facing layer of pliable fabric containing a plurality of horizontal pleats tightly bonded to said backing sheet, said facing layer and backing sheet defining a unitary, pliable, permanently pleated window covering conforming to the window; and mounting apparatus attached to the window covering for mounting the window covering to a window, said apparatus including adjusting means for raising and lowering the window covering with respect to such window.

7. A window shade in accordance with claim 6, wherein said adjusting means comprises a spring-driven roller.

8. A window shade in accordance with claim 6, wherein said adjusting means comprises pull-up hardware.

9. A method for constructing a window shade, comprising:

providing a pliable, fusible, nonwoven backing sheet selectively sized and configured to conform to a window;

tightly bonding a facing layer of pliable fabric containing a plurality of horizontal pleats to said backing sheet, whereby said facing layer and backing sheet define a unitary, pliable, permanently pleated window covering conforming to the window;

providing a mounting apparatus for mounting the window covering to a window, the apparatus including adjusting means for raising and lowering the window covering with respect to such window; and operatively attaching the window covering to the adjusting means of said mounting apparatus.

* * * * *